United States Patent [19]

Engel et al.

[11] Patent Number: 5,062,633

[45] Date of Patent: Nov. 5, 1991

[54] BODY-BUILDING EXERCISE APPARATUS

[75] Inventors: Timothy S. Engel, Bloomington; Robert A. Iverson, Eden Prairie, both of Minn.

[73] Assignee: Nordictrack, Inc., Chaska, Minn.

[21] Appl. No.: 575,968

[22] Filed: Aug. 31, 1990

[51] Int. Cl.[5] ..... A63B 21/015

[52] U.S. Cl. ..... 272/132; 272/143; 272/131

[58] Field of Search ..... 272/65, 131, 132, 134, 272/143

[56] References Cited

U.S. PATENT DOCUMENTS

| | | | |
|---|---|---|---|
| 2,530,921 | 11/1950 | Tougas . | |
| 2,777,439 | 1/1957 | Tuttle . | |
| 3,953,025 | 4/1976 | Mazman | 272/132 |
| 4,154,441 | 5/1979 | Gajda | 272/117 |
| 4,408,759 | 10/1983 | Reneau et al. | 272/131 |
| 4,484,741 | 11/1984 | Bingisser | 272/131 |
| 4,518,163 | 5/1985 | Bruder | 272/132 |
| 4,570,925 | 2/1986 | Knock et al. | 272/131 X |
| 4,611,807 | 9/1986 | Castillo | 272/132 |
| 4,641,832 | 2/1987 | Mattox | 272/131 X |
| 4,655,452 | 4/1987 | Huerstel | 272/132 X |
| 4,720,099 | 1/1988 | Carlson | 272/134 |
| 4,749,182 | 6/1988 | Duggan | 272/73 |
| 4,772,015 | 9/1988 | Carlson et al. | 272/143 X |
| 4,779,866 | 10/1988 | Marshall et al. | 272/132 |
| 4,801,139 | 1/1989 | Vanhoutte et al. | 272/130 |
| 4,872,669 | 10/1989 | Henry | 272/132 |
| 4,957,281 | 9/1990 | Christolear, Jr. | 272/134 X |

*Primary Examiner*—Richard J. Apley
*Assistant Examiner*—L. Thomas
*Attorney, Agent, or Firm*—Merchant, Gould, Smith, Edell, Welter & Schmidt

[57] ABSTRACT

The invention is an exercise apparatus 99 capable of providing a full body workout and collapsible to a storage configuration that occupies relatively little space. A disc brake resistance device 40 provides a system of positive/positive resistance against rotational movement that feels smooth and is safe in operation. The opposing force and relative location of the resistance device 40 can be adjusted to adapt the apparatus 99 to persons of different sizes and exercises of different types. The attachments 80 and 90 facilitate numerous exercises involving various muscles of a person's body.

8 Claims, 4 Drawing Sheets

BODY-BUILDING EXERCISE APPARATUS

FIELD OF THE INVENTION

This invention relates generally to exercise equipment and more particularly, to a collapsible exercise apparatus capable of facilitating a variety of body-building exercises.

BACKGROUND OF THE INVENTION

The typical training room of a health and fitness club is evidence that there is a wide variety of exercise equipment currently available. In addition to traditional free weights, there are numerous devices suitable for exercising particular muscles or muscle groups. Typically, in order to achieve a full body workout, one must resort to several different machines and/or free weights. Not only is it unlikely that the average person can afford to acquire and/or house these numerous exercise machines, but it may be inconvenient to move from machine to machine in a training room, or even to gain access to a training room. Also, it may be inconvenient to adjust each machine prior to use.

Certain exercise machines, as well as free weights, may be potentially dangerous because at some stage of an exercise there is an accumulation of potential energy. If the person exercising is unable to withstand this accumulated potential energy, such as free weights being held over one's head, then the free weights are going to overwhelm the person and possibly cause serious injury. Such a possibility is particularly worrisome where a person is exercising to rehabilitate an injured muscle or associated body part, which may not be entirely reliable due to the injury.

Another problem with many of the currently available exercise machines, as well as free weights, is that they are designed to provide opposition to linear movement. Basically, a person's body operates on a rotational basis, wherein a person's limbs pivot about joints in response to flexing and extending muscles. Thus, a more natural and steady workout would involve application of force against opposition to rotational movement, rather than linear movement.

The present invention addresses the above-noted problems with existing exercise apparatus. The exercise apparatus of the present invention is capable of providing a full body workout, yet is simple in construction and affordable. It is collapsible to a storage configuration that requires relatively little space, and is readily adjustable to accommodate persons of different sizes and exercises of different types. Also, the exercise apparatus of the present invention provides a system of positive/positive resistance to rotational movement, in which nothing moves unless in response to a force applied by the person exercising.

SUMMARY OF THE INVENTION

According to one aspect of the present invention, there is provided an exercise apparatus designed to oppose rotational movement in a predetermined direction up to a predetermined force. The apparatus includes a pair of support members which are pivotal between an unfolded, supportive configuration and a folded, storage configuration. The apparatus also includes resistance means for opposing rotational movement up to the predetermined force, and application means for applying force in the predetermined direction.

According to another aspect of the invention, there is provided a method of exercising with an exercise apparatus. The process includes the steps of determining an exercise to be performed, selecting an attachment that is appropriate for the exercise, and attaching the attachment to a resistance device. A person positions his or her body in a suitable position relative to the resistance device according to the exercise determined and makes certain adjustments according to the exercise determined, including adjustment of the height and angle of the resistance device. After adjusting the resistance force applied by the resistance device, a person moves an attachment between a first position and a second position against the resistance force according to the exercise determined.

According to a preferred embodiment, there is provided an exercise apparatus designed to facilitate a full body workout. The apparatus includes a base portion having a width and a length, and a pair of base support members that are operatively connected to the base portion by pairs of hinge members. The base support members pivot between a supportive configuration and a storage configuration. In the storage configuration, the overall width of the apparatus is approximately eight inches, and thus, the apparatus may be easily stored underneath a bed. There is a seat that is releasably secured to the base portion at one of several positions along the length of the base portion. Also, there is a resistance device, which is slidably and rotatably mounted to a support pole. The resistance device includes a shaft member and a disc, both of which are rotatably mounted within a housing. Resistance to rotation of the disc and shaft is controlled by adjustable resistance means. An attachment member, which is secured to the shaft member of the resistance device, is designed to transmit force against the resistance of the adjustable resistance means.

The present invention provides an exercise apparatus that is advantageous in several respects. The apparatus is readily adjustable and includes alternative attachments to facilitate a wide range of exercises for a full-body workout. A primary attachment is adjustable relative to the shaft member of the resistance device to allow variation of the radius of the range of motion, and the resistance device is adjustable vertically along the support pole to allow variation of the center of the range of motion relative to the user. Accordingly, the apparatus is particularly suitable for therapy exercise, where it is desirable to isolate a particular muscle and/or range or motion.

The apparatus is particularly safe in operation due to the "positive/positive" system of resistance against rotational movement. The apparatus does not move except in response to force applied by the user, because there is no accumulation of potential energy at any stage of any exercise. For example, if a flexor muscle is used to move the primary attachment clockwise, then the corresponding extensor muscle must be used to move the primary attachment back counterclockwise. The "positive/positive" system eliminates the risk of accumulated force overwhelming a person, in therapy or otherwise. Also, this feature is beneficial because two corresponding yet distinct muscles are exercised during a single range of motion.

The focus on rotational movement, rather than linear movement, accommodates the natural mechanics of a person's body. Both hinge joints, such as the elbow and knee, and ball and socket joints, such as the shoulder and hip, involve arc-like movement of an extremity about a fixed, central point. In conjunction with the "positive/positive" resistance, the rotational movement ensures a constant opposing force to the flexing or extending or a muscle. Thus, the "positive/positive" system of resistance against rotational movement makes the apparatus particularly suitable for therapy exercise.

The apparatus is relatively simple in construction and relatively inexpensive, especially in view of the fact that it facilitates such a wide range of exercises. Also, the apparatus is collapsible and thus, does not require a great deal of space when not being used. Again, this is especially significant in view of the fact that the apparatus facilitates a full body workout. Finally, the apparatus is relatively easy to use and transform from an operable configuration to a storage configuration. All that is required is loosening and tightening of one or more adjustment knobs and insertion and removal of a few locking pins, respectively.

These and other advantages will become apparent upon a more detailed description of the invention.

DESCRIPTION OF THE DRAWING

Referring to the Figures, wherein like numerals represent like parts throughout the several views.

DESCRIPTION OF THE PREFERRED EMBODIMENT

Figure 1:
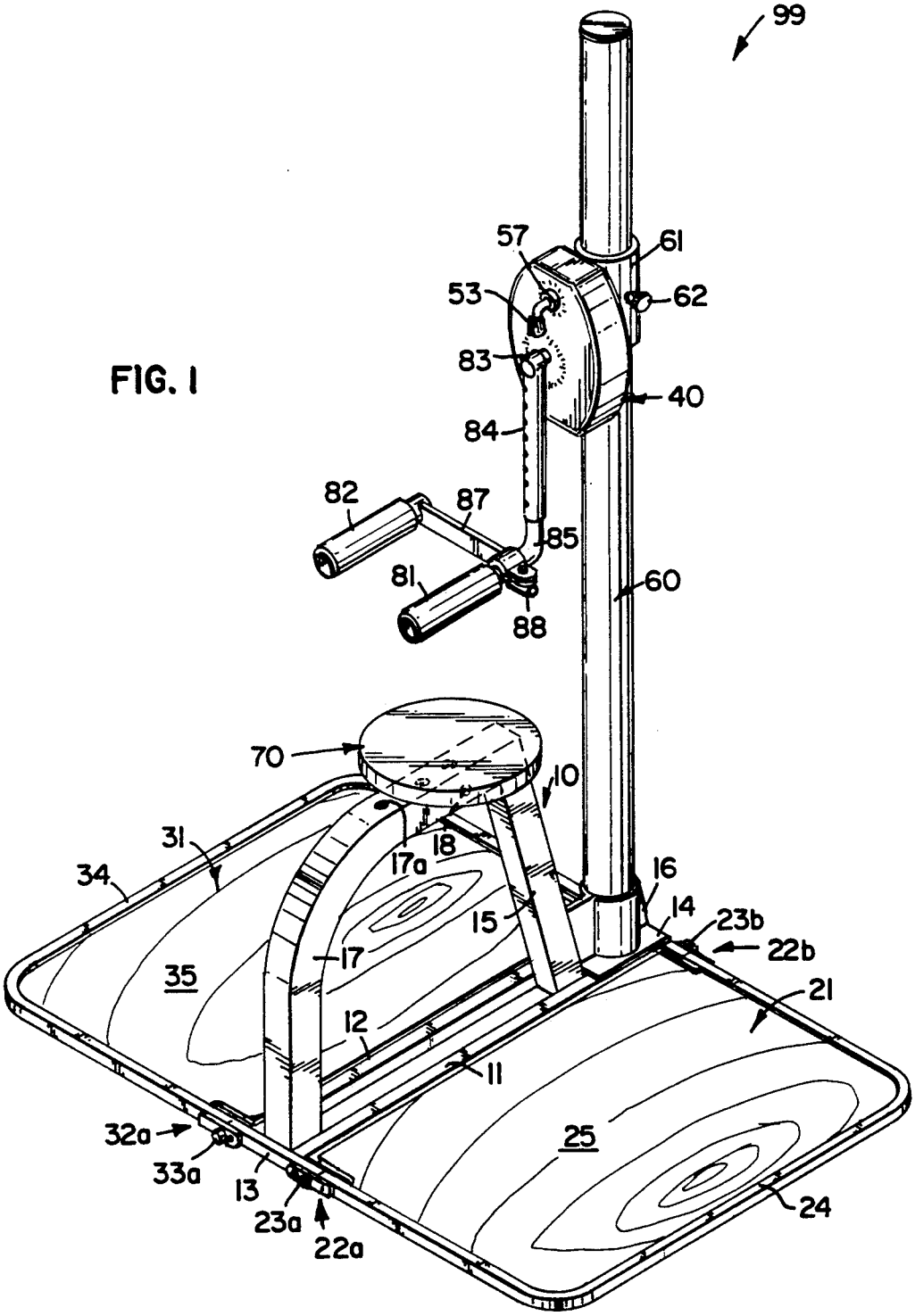
FIG. 1 is a perspective view of a preferred embodiment of an exercise apparatus in an operative configuration.
Figure 2:
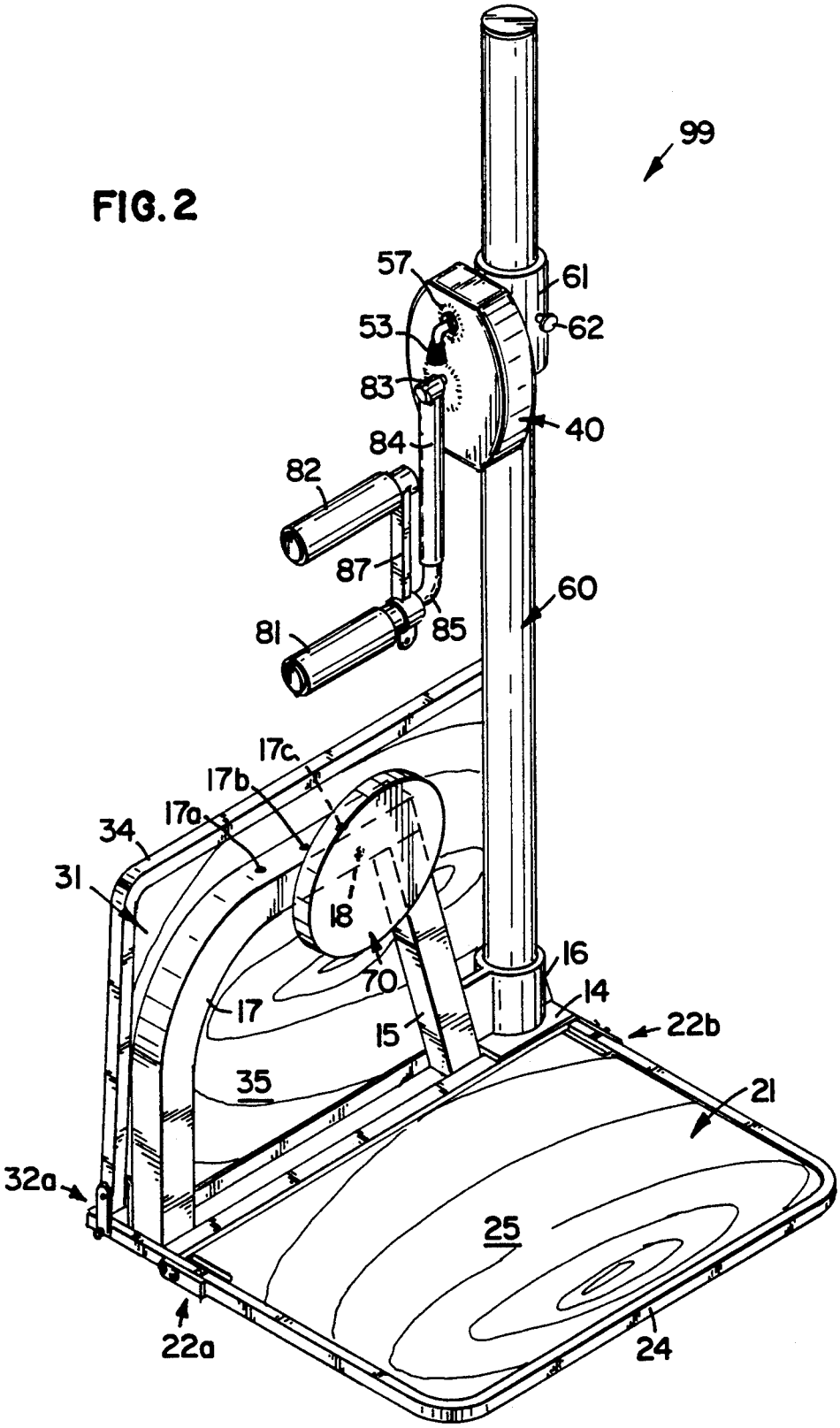
FIG. 2 is a perspective view of the exercise apparatus of FIG. 1 shown in a partial storage configuration.

A preferred embodiment of an exercise apparatus 99 is shown in an operable configuration in FIG. 1. The apparatus 99 generally includes a base portion 10, base support members 21 and 31, a seat 70, a support pole 60, and a resistance device 40. The base support members 21 and 31 are pivotally connected to the base portion 10 and moveable between an unfolded, supportive configuration, whereby the exercise apparatus is in an operable configuration, and a folded, storage configuration, as shown in FIG. 2. The seat 70 is releasably secured relative to the base portion 10. The resistance device 40 is adjustably secured to the support pole 60, which is rigidly secured to the base portion 10.

As shown in FIG. 1, the base portion 10 includes a first central transverse support bar 11 and a second central transverse support bar 12, both of which are steel tubes, preferably approximately one inch by one inch in size. The central transverse support bars 11 and 12 are rigidly joined at one end to first end member 13 and at the other end to second end member 14, both of which are steel tubes, preferably approximately one-half inch by one inch in size.

A collar member 16 is rigidly attached to the second end member 14 and to the central transverse support bars 11 and 12. An upright seat support member 15, which is a steel tube, preferably approximately two inches by two inches in size, is rigidly attached to the collar member 16 and to the central transverse support bars 11 and 12. A transverse seat support member 17, which is a curved steel tube, preferably approximately two inches by two inches in size, is rigidly attached at one end to the upright member 15 and at the other end to the first end member 13 and the central transverse support bars 11 and 12.

In the operable configuration, the exercise apparatus 99 is supported by the base support members 21 and 31. The base support members 21 and 31 include outer frame members 24 and 34, respectively, which are steel tubes, preferably approximately one-half inch by one inch in size, and extend around the periphery of base support members 21 and 31. The base support members 21 and 31 also include platform members 25 and 35, respectively, which are preferably plywood sheets, approximately one-half inch thick, secured relative to the frame members 24 and 34, respectively, by brackets (not shown).

In the operable configuration, the base support members 21 and 31 ar unfolded to lie flat against the support floor, so as to provide a supportive exercise platform. The base support members 21 and 31 are pivotally attached to the base portion 10 by hinge members **22*a* and 22*b*, and 32*a* and a fourth hinge member (not shown), respectively, and secured in the operable position by detent pins 23*a* and 23*b*, and 33*a* and a fourth detent pin (not shown), respectively. The exercise apparatus 99 can be transformed into a storage configuration by relocating the seat 70 (as explained below) and removing the detent pins 23*a* and 23*b*, and 33*a* and the fourth detent pin (not shown), and folding the base support members 21 and 31 relative to the base portion 10 (as shown in FIG. 2 for base support member 31**).

Figure 3:
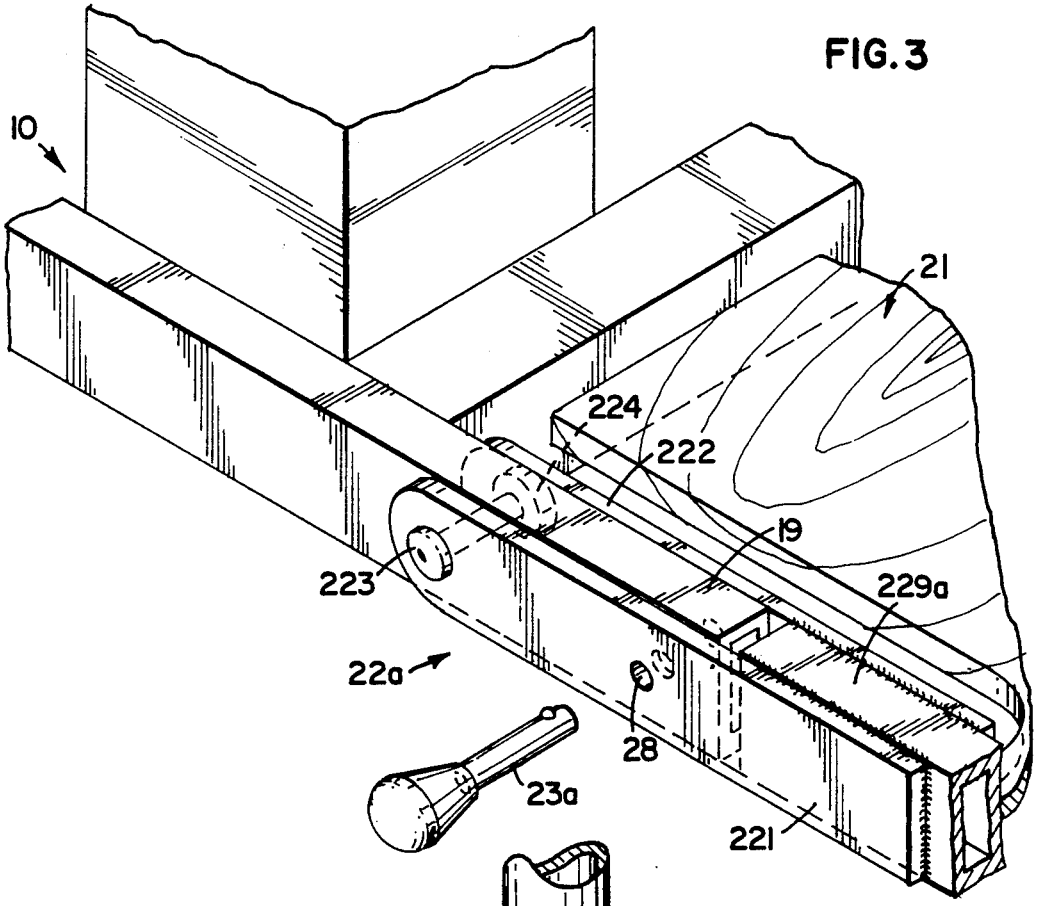
FIG. 3 is an enlarged view of a hinge member of the exercise apparatus of FIG. 1.

The hinge member **22*a*, which is representative of the other hinge members 22*b*, 32*a*, and the fourth hinge member (not shown), is shown in detail in FIG. 3. A bolt 223 passes through a first hole in one end of a first brace member 221, through a first hole in end 19*a* of the base portion 10, and through a first hole in one end of a second brace member 222. A nut 224 is fastened to the bolt 223, and the brace members 221 and 222 are effectively rotatably mounted to the base portion 10. The opposite ends of the brace members 221 and 222 are welded to end 29*a* of the base support member 21, which is then effectively rotatably mounted to the base portion 10. The base support member 21 is secured in the unfolded, supportive configuration by insertion of the detent pin 23*a* through a second hole 28*a* in the first brace member 221, through a second hole in the end 19*a* of the base portion 10, and through a second hole in the second brace member 222. The detent pin 23*a*** is of a type that locks itself in position.

As shown in FIG. 1, when the exercise apparatus 99 is in the operable configuration, the seat 70 is positioned on the transverse seat support member 17. The seat 70 is preferably made of a wood material so as to be aesthetically pleasing. A pole member (not shown) which extends from beneath the seat 70, inserts into any of a series of holes **17*a*, 17*b*, and 17*c* in the transverse seat support member 17. The series of holes 17*a*, 17*b*, and 17*c* allows transverse adjustment of the seat 70 relative to the resistance device 40. As shown in FIG. 2, before the exercise apparatus 99 is transformed into the storage configuration, the seat 70 is removed, and the pole member is inserted in a side hole 18 in the transverse seat support member 17. The support pole 60**, which is an aluminum steel tube, preferably approximately 3 inches in diameter, is rigidly secured within the collar member 16. A sleeve member 61 is releasably fastened to the support pole 60 by a locking knob 62. As a result, the sleeve member 61 can be moved "up" and "down" and rotated about the support pole 60. The resistance device 40 is rigidly secured to the sleeve member 61 and thus, capable of the same movements relative to the support pole 60. Accordingly, it is possible to adjust the resistance device 40 vertically and angularly relative to the seat 70.

Figure 4:
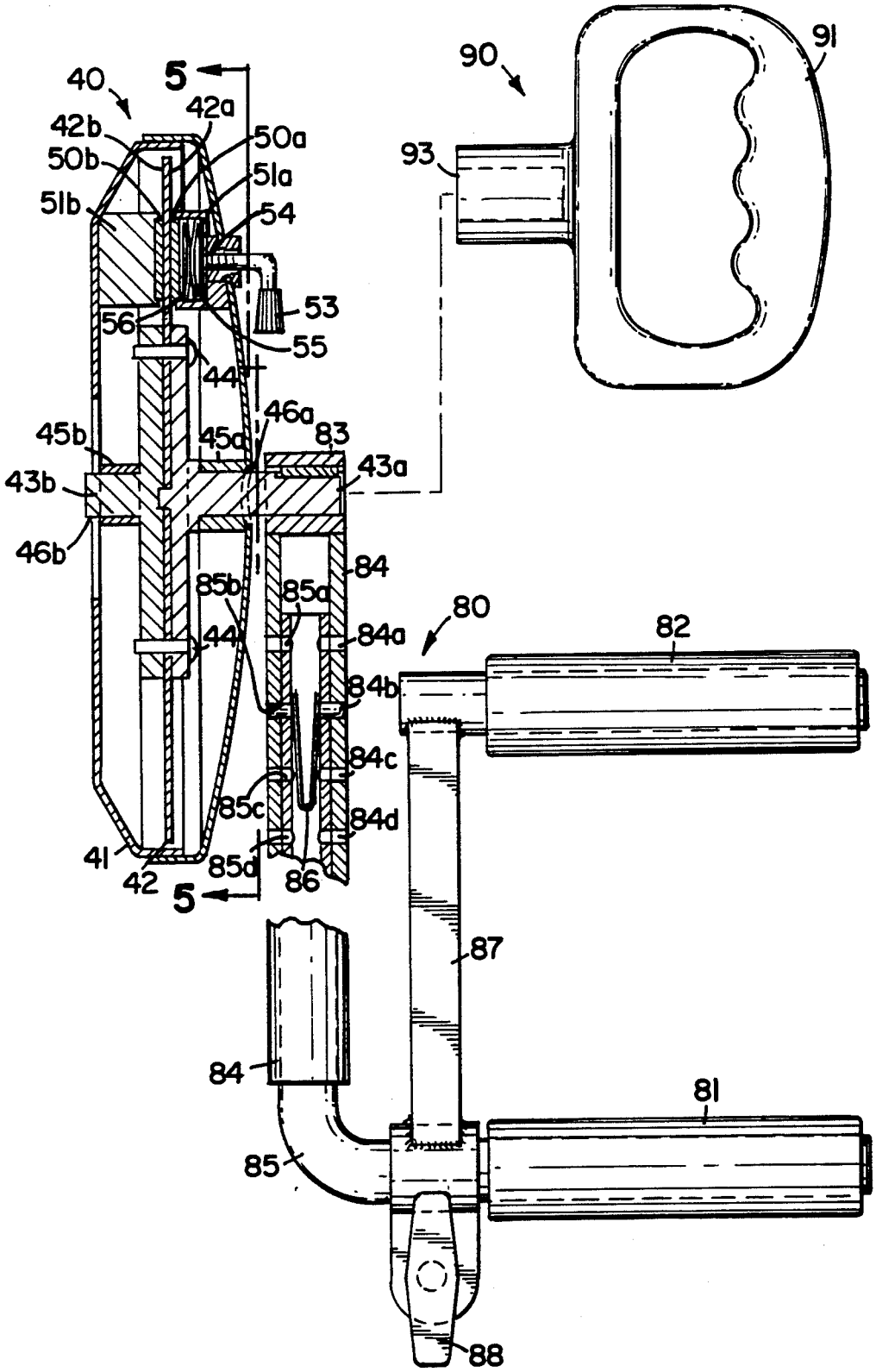
FIG. 4 is a side-sectional view of a resistance device of the exercise apparatus of FIG. 1, including alternative attachments to the resistance device.

As shown in FIG. 4, the resistance device 40 includes a resistance device housing 41. Inside the resistance device housing 41 is a disc 42, which is a flexible steel disc, preferably approximately ten inches in diameter and 0.030 inches thick. The disc 42 is mounted between a front shaft member 43*a* and a rear shaft member 43*b* by four button head screws 44. Front and rear oil lite bearings 45*a* and 45*b* are secured within front and rear shaft member holes 46*a* and 46*b*, respectively, in the resistance device housing 41, and the shaft members 43*a* and 43*b* are rotatably secured relative to the oil lite bearings 45*a* and 45*b*, respectively. As a result, the shaft members 43*a* and 43*b* and the disc 42 are rotatably mounted relative to the resistance device housing 41.

Front and rear pads 50*a* and 50*b*, which are circular leather pieces, preferably approximately one inch in diameter and one-quarter inch thick, are positioned in contact with the front and the rear sides 42*a* and 42*b*, respectively, of a peripheral portion of the disc 42. Pressure between the pads 50*a* and 50*b* and the disc 42 provide the means for resisting rotational movement up to a predetermined force. The pads 50*a* and 50*b* are secured relative to pad housings 51*a* and 51*b*, respectively. A resistance adjustment knob 53 passes through a hole 54 in the front pad housing 51*a* and engages a pair of beveled washers 55 and 56, which are in contact with the front pad 50*a*. The disc 42 and the pads 50*a* and 50*b* are designed to interact in such a manner that the resistance to rotation feels "smooth" to a person using the exercise apparatus 99.

The resistance adjustment knob 53 is mounted to the pad housing 51*a* in such a manner that rotation of the resistance adjustment knob 53 in one direction increases the pressure between the washers 55 and 56 and the front pad 50*a* and thus, between the pads 50*a* and 50*b* and the disc 42, and rotation of the resistance adjustment knob 53 in the opposite direction decreases the pressure between the washers 55 and 56 and the front pad 50*a* and thus between the pads 50*a* and 50*b* and the disc 42. Thus, means for adjusting the force in opposition to rotational movement is provided by rotation of the resistance adjustment knob 53, which increases or decreases the pressure of the pads 50*a* and 50*b* on the disc 42.

Figure 5:
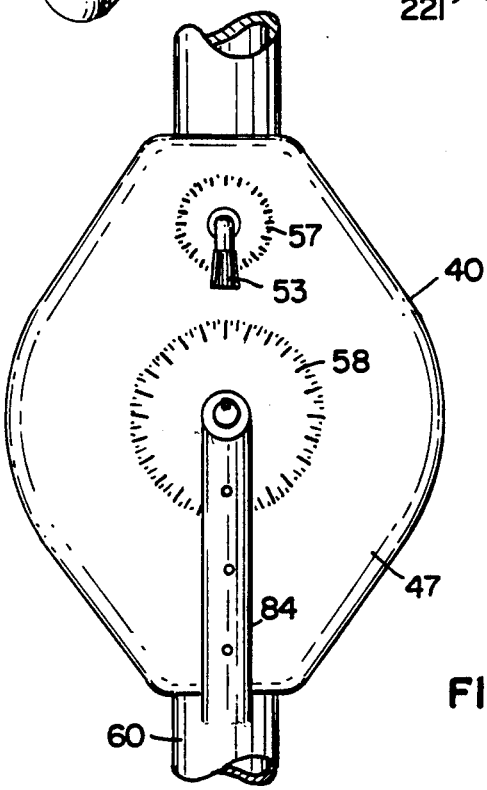
FIG. 5 is a front view of the housing for the resistance device of FIG. 4.

As shown in FIG. 5, there is a scale 57 on the front side 47 of the resistance device housing 41, which indicates the resistance (preferably in pounds) against rotational movement. Also, there is a gyniometer 58 on the front side 47 of the resistance device housing 41, which indicates the range (preferably in degrees) of rotational movement.

As shown in FIG. 4, the present invention provides means for applying force against the resistance to rotational movement. A primary attachment member 80 is releasably secured to the resistance device 40 by a collar 83 that fits snugly over the front shaft member 43*a*. Since the front shaft member 43*a* is mounted to the disc 42 and rotatably mounted relative to the resistance device housing 41, a rotational force applied through the primary attachment member 80 is directly opposed by the pressure of the opposing pads 50*a* and 50*b* on the disc 42. Depending on the particular exercise to be performed, force is applied through a first handle 81 and/or a second handle 82.

The primary attachment member 80 includes a radial member 84, having the collar 83 at its anchored end, and having a handle member 85 extending out its rotating end. The handle member 85 telescopes into and out of the radial member 84 and is releasably secured relative to the radial member 84 by a snap button 86 that snaps into engagement with one of the series of holes 84*a*–84*d* and with one of the series of holes 85*a*–85*d*. Thus, the effective radial length of the primary attachment member 80 can be adjusted by pushing the snap button out of engagement with any of the holes 84*a*–84*d* and sliding the handle member 85 relative to the radial member 84 until the snap button snaps into engagement with a hole adjacent to the hole previously engaged.

The handle member 85 is substantially L-shaped, such that the first handle 81 extends perpendicularly from the portion of the handle member 85 that slides within the radial member 84. The second handle 82, which is substantially parallel to the first handle 81, is connected to the first handle 81 by an orbital member 87 that is rotatably mounted to the handle member 85 and releasably secured by a locking nut 88.

Also shown in FIG. 4 is an alternative attachment member 90 which provides means for applying force against the opposition to rotational movement. The alternative attachment member 90 includes a collar 93 that fits snugly over the front shaft member 43*a* to releasably secure the alternative attachment member 90 to the resistance device 40. The alternative attachment member 90 extends substantially perpendicularly from a plane defined by the disc 42. A handle 91, which is substantially parallel to the plane defined by the disc 42, is configured to be comfortably gripped by a person's hand. The alternative attachment member 90 facilitates twisting exercises of the forearm relative to the elbow and the entire arm relative to the shoulder.

As a result of the various adjustment capabilities of the exercise apparatus 99 and the alternative attachments, the exercise apparatus 99 is suitable for persons of various sizes and exercises of various kinds. In order to exercise with the exercise apparatus 99, the user first determines an exercise to be performed. For example, the user might choose to do elbow flexions and elbow extensions in order to exercise the biceps and triceps muscles, respectively.

The primary attachment member 80 is suitable for elbow flexions and elbow extensions. Thus, the user attaches the primary attachment member 80 to the front shaft member 43*a*. The user then assumes a suitable position for the exercise to be performed. In the case of elbow flexions and elbow extensions, the user can be either standing or sitting. In either case, once the user's position is established, the user adjusts the resistance device 40 relative to the support pole 60 so that the height and angle of the resistance device 40 are suitable for the exercise to be performed. In the case of elbow flexions and elbow extensions, the user adjusts the height of the resistance device 40 so that the front shaft member 43*a* (the pivot point) corresponds to the height of the user's elbow. The user adjusts the angle of the resistance device 40 so that the front side 47 of the resistance device housing 41 faces toward the user's side.

Assuming that the user intends to grip the first handle 81, the second handle 82 should be positioned in such a manner that it does not interfere with the desired range of motion. Next, the user adjusts the radial length (the distance between the front shaft member 43*a* and the first handle 81) according to the exercise determined. In the case of elbow flexions and extensions, the user adjusts the radial length to correspond approximately to the length of the user's forearm. The user then adjusts the resistance force by turning the adjustment knob 53 to the desired resistance. Finally, the user grips the handle 81 of the primary attachment member 80 and flexes and extends the biceps and triceps muscles, respectively.

The same process is followed for each exercise determined. Other common exercises that are typically performed through the first handle 81 of the primary attachment member 80 include shoulder abduction and circumduction, shoulder internal and external rotation, shoulder flexion and extension, military press, pectoral press and flys, latissimus pull-downs, spinal extension, trunk-side flexion, and abdominal flexion.

By positioning the second handle 82 in such a manner that it extends radially from the front shaft member 43*a*, the user can effectively lengthen the primary attachment member 80 to facilitate various exercises of the muscles of the legs, buttocks, and hips, including knee flexion and extension, hip flexion and extension, and hip abduction and adduction. By positioning the second handle 82 in such a manner that it extends tangentially relative to the front shaft member 43*a*, the user can adapt the primary attachment member 80 to facilitate exercises of the neck. The user presses his head or upper neck against one of the handles and pushes the primary attachment member 80 in a first direction, and the user grasps the other handle to pull the primary attachment member 80 back in the opposite direction.

The handles 81 and 82 of the primary attachment member 80 are necessarily confined to rotational movement. By properly positioning the resistance device 40 and adjusting the radial length of the primary attachment member 80, the user can adapt the opposition to rotational movement to correspond to the natural movement of his limbs, thus providing smooth and constant opposition to the flexing or extension of his muscles.

While the invention is described with respect to a preferred embodiment, it will be understood that the invention is not limited to such design. Further, the invention is not limited to any of the specifics of construction, other than as described within the appended claims. These and other variations of the invention will be apparent to those skilled in the art.

What is claimed is:

1. An exercise apparatus designed to oppose rotational movement in a predetermined direction up to a predetermined force, comprising:

(a) a first support member which is pivotal between an unfolded, supportive configuration and a folded, storage configuration;

(b) a second support member which is pivotal between an unfolded, supportive configuration and a folded, storage configuration;

(c) resistance means for opposing rotational movement up to the predetermined force, wherein said resistance means includes a disc rotatably mounted between opposing pads, wherein said opposing pads apply pressure on said disc to provide opposition to rotational movement up to the predetermined force;

(d) application means for applying force in the predetermined direction, wherein said application means includes an attachment member, including a radial member, a first handle, an orbital extension member, and a second handle, wherein said radial member is releasably secured relative to said disc and extends substantially parallel to a plane defined by said disc, and said first handle is mounted on said radial member in such a manner that said first handle is substantially perpendicular to the plane defined by said disc and said first handle is radially adjustable relative to said disc, and said orbital extension member is rotatably, releasably mounted to said first handle, and said second handle is mounted to said orbital extension member in such a manner that said second handle is substantially parallel to said first handle;

(e) a base portion, to which said support members are pivotally mounted, and to which a seat is releasably mounted, said seat being transversely adjustable relative to said resistance means;

(f) direction adjustment means for adjusting the predetermined direction, wherein said direction adjustment means includes a support pole rigidly secured to said base portion, and a sleeve member slidably and rotatably secured to said support pole, wherein said resistance means is rigidly secured to said sleeve member; and (g) force adjustment means for adjusting the predetermined force, wherein said force adjustment means includes a pair of spring washers positioned adjacent one of said opposing pads, and an adjustment knob threadably mounted adjacent one of said spring washers, wherein rotation of said adjustment knobs adjusts the pressure of said opposing pads on said disc.

2. An exercise apparatus designed to oppose rotational movement in a predetermined direction up to a predetermined force, comprising:

(a) a first support member which is pivotal between an unfolded, supportive configuration and a folded, storage configuration;

(b) a second support member which is pivotal between an unfolded, supportive configuration and a folded, storage configuration;

(c) resistance means for opposing rotational movement up to the predetermined force, wherein said resistance means includes a disc rotatably mounted between opposing pads, wherein said opposing pads apply pressure on said disc to provide opposition to rotational movement up to the predetermined force;

(d) application means for applying force in the predetermined direction, wherein said application means includes an attachment member releasably secured relative to said disc and extending substantially perpendicularly from a plane defined by said disc, wherein said attachment member includes a handle that is substantially parallel to the plane defined by said disc;

(e) a base portion, to which said support members are pivotally mounted, and to which a seat is releasably mounted, said seat being transversely adjustable relative to said resistance means;

(f) direction adjustment means for adjusting the predetermined direction, wherein said direction adjustment means includes a support pole rigidly secured to said base portion, and a sleeve member slidably and rotatably secured to said support pole, wherein said resistance means is rigidly secured to said sleeve member;

(g) force adjustment means for adjusting the predetermined force, wherein said force adjustment means includes a pair of spring washers positioned adjacent one of said opposing pads, and an adjustment knob threadably mounted adjacent one of said spring washers, wherein rotation of said adjustment knobs adjusts the pressure of said opposing pads on said disc.

3. An exercise apparatus designed to oppose rotational movement in a predetermined direction up to a predetermined force, comprising:

(a) a first support member which is pivotal between an unfolded, supportive configuration and a folded, storage configuration;

(b) a second support member which is pivotal between an unfolded, supportive configuration and a folded, storage configuration;

(c) resistance means for opposing rotational movement up to the predetermined force, wherein said resistance means includes a disc rotatably mounted between opposing pads, wherein said opposing pads apply pressure on said disc to provide opposition to rotational movement up to the predetermined force;

(d) application means for applying force in the predetermined direction, wherein said application means includes an attachment member, including a radial member, a first handle, an orbital extension member, and a second handle, wherein said radial member is releasably secured relative to said disc and extends substantially parallel to a plane defined by said disc, and said first handle is mounted on said radial member in such a manner that said first handle is substantially perpendicular to the plane defined by said disc and said first handle is radially adjustable relative to said disc, and said orbital extension member is rotatably, releasably mounted to said first handle, and said second handle is mounted to said orbital extension member in such a manner that said second handle is substantially parallel to said first handle .

4. An exercise apparatus designed to oppose rotational movement in a predetermined direction up to a predetermined force, comprising:

(a) a first support member which is pivotal between an unfolded, supportive configuration and a folded, storage configuration;

(b) a second support member which is pivotal between an unfolded, supportive configuration and a folded, storage configuration;

(c) resistance means for opposing rotational movement up to the predetermined force, wherein said resistance means includes a disc rotatably mounted between opposing pads, wherein said opposing pads apply pressure on said disc to provide opposition to rotational movement up to the predetermined force;

(d) application means for applying force in the predetermined direction, wherein said application means includes an attachment member releasably secured relative to said disc and extending substantially perpendicularly from a plane defined by said disc, wherein said attachment member includes a handle that is substantially parallel to the plane defined by said disc.

5. An exercise apparatus designed to facilitate a full body workout, comprising:

(a) a base portion having a width and a length, wherein said width is approximately eight inches;

(b) a first base support member, operatively connected to said base portion by a pair of hinge members, wherein said first base support member pivots between a supportive configuration and a storage configuration;

(c) a second base support member, operatively connected to said base portion by a pair of hinge members, wherein said second base support member pivots between a supportive configuration and a storage configuration;

(d) a seat, releasably secured to said base portion at one of a plurality of positions along said length of said base portion;

(e) a support pole, rigidly attached to said base portion and extending perpendicularly from said base portion;

(f) a resistance device, slidably and rotatably mounted to said support pole, comprising:

(i) a housing;

(ii) a shaft member, rotatably mounted within said housing;

(iii) a disc, rigidly secured to said shaft member and rotatably mounted within said housing; and (iv) adjustable resistance means, secured relative to said housing and in contact with said disc, for resisting rotation of said disc; and (g) an attachment member, attached to said shaft member of said resistance device, wherein said attachment member is designed to transmit force against said adjustable resistance means of said resistance device.

6. An exercise apparatus according to claim 5, wherein said adjustable resistance means includes a pair of opposing pads positioned on opposite sides of said disc, a pair of spring washers adjacent one of said pads, and a threaded adjustment knob adjacent one of said washers, wherein rotation of said knob in one direction increases pressure between said washers and between said pads and said disc, and rotation of said knob in an opposite direction decreases pressure between said washers and between said pads and said disc.

7. An exercise apparatus according to claim 5, wherein said attachment member includes a radial member, a first handle, an orbital extension member, and a second handle, wherein said radial member is releasably secured relative to said disc and extends substantially parallel to a plane defined by said disc, and said first handle is mounted on said radial member in such a manner that said first handle is substantially perpendicular to the plane defined by said disc and said first handle is radially adjustable relative to said disc, and said orbital extension member is rotatably, releasably mounted to said first handle, and said second handle is mounted to said orbital extension member in such a manner that said second handle is substantially parallel to said first handle.

8. An exercise apparatus according to claim 5, wherein said attachment member is releasably secured relative to said disc and extending substantially perpendicularly from a plane defined by said disc, wherein said attachment member includes a handle that is substantially parallel to the plane defined by said disc.

* * * * *